US009139341B2

(12) United States Patent
Rossignol

(10) Patent No.: US 9,139,341 B2
(45) Date of Patent: Sep. 22, 2015

(54) UNIT FOR DISPENSING A PRODUCT COMPRISING A CASE AND A CASSETTE

(71) Applicant: ALBEA LACROST, Lacrost (FR)

(72) Inventor: Eric Rossignol, Chalon sur Saone (FR)

(73) Assignee: Albea LaCrost, LaCrost (FR)

( * ) Notice: Subject to any disclaimer, the term of this patent is extended or adjusted under 35 U.S.C. 154(b) by 48 days.

(21) Appl. No.: 14/182,420

(22) Filed: Feb. 18, 2014

(65) Prior Publication Data

US 2014/0231461 A1 Aug. 21, 2014

(30) Foreign Application Priority Data

Feb. 20, 2013 (FR) ..... 13 51464

(51) Int. Cl.

| | |
|---|---|
| ***B67D 7/06*** | (2010.01) |
| ***B65D 35/28*** | (2006.01) |
| ***A45D 33/22*** | (2006.01) |
| *A45D 34/00* | (2006.01) |

(52) U.S. Cl.

CPC ..... *B65D 35/28* (2013.01); *A45D 33/22* (2013.01); *A45D 2034/005* (2013.01)

(58) Field of Classification Search

CPC ..... B65D 35/28; B65D 35/26; B65D 35/44; B65D 35/565; A45D 33/22; A45D 2034/005; A45D 220/056

USPC ..... 222/138, 105, 106, 206–216, 173, 131, 222/153.01, 153.02, 153.04, 153.11; 132/312, 315

See application file for complete search history.

(56) References Cited

U.S. PATENT DOCUMENTS

| | | | | |
|---|---|---|---|---|
| 5,250,037 | A * | 10/1993 | Bitdinger | 604/192 |
| 5,620,420 | A * | 4/1997 | Kriesel | 604/133 |
| 5,666,146 | A * | 9/1997 | Mochizuki et al. | 347/86 |
| 5,891,096 | A * | 4/1999 | Hyun et al. | 604/131 |
| 5,957,895 | A * | 9/1999 | Sage et al. | 604/181 |
| 6,076,679 | A | 6/2000 | Yukitomo et al. | |
| 7,981,076 | B2 * | 7/2011 | Sullivan et al. | 604/82 |
| 8,128,596 | B2 * | 3/2012 | Carter | 604/131 |
| 8,821,472 | B2 * | 9/2014 | Sparholt et al. | 604/415 |
| 2010/0038380 | A1 * | 2/2010 | Compton | 222/105 |
| 2010/0084432 | A1 * | 4/2010 | Pelfrey | 222/153.13 |

FOREIGN PATENT DOCUMENTS

| | | | |
|---|---|---|---|
| WO | 2011/144840 | A1 | 11/2011 |
| WO | 2012/151553 | A1 | 11/2012 |

OTHER PUBLICATIONS

French Patent Application 1351464, International Search Report, dated Sep. 25, 2013.

* cited by examiner

*Primary Examiner* — Lien Ngo

(74) *Attorney, Agent, or Firm* — Banner & Witcoff, Ltd.

(57) ABSTRACT

The invention relates to a unit for dispensing a product comprising a case (1) and a cassette (2) which has a zone for dispensing (7) the product conditioned in a reservoir of said cassette, said cassette intended to be arranged in a housing (3) formed in a body of said case by arranging said dispensing zone in an access window (8) which is formed in an upper wall (4) of said body, said unit comprising a reversible locking mechanism of the cassette (2) in the housing (3) which has a frame (27) mounted in horizontal translation in said housing by being maintained vertically, said frame and said cassette being provided with complementary means which are arranged to, in a first position of the frame (27), allow for the arranging of the cassette (2) in the housing (3) with the dispensing zone (7) in the window (8) and, in a second position of said frame, lock the position of said cassette in said housing.

15 Claims, 6 Drawing Sheets

UNIT FOR DISPENSING A PRODUCT COMPRISING A CASE AND A CASSETTE

CROSS REFERENCE TO RELATED APPLICATIONS

This application claims the benefit of French Patent Application No. FR-13 51464 filed Feb. 20, 2013, which is hereby incorporated herein by reference in its entirety.

The invention relates to a unit for dispensing a product comprising a case and a cassette wherein the product to be dispensed is conditioned.

In particular, the product to be dispensed can be fluid, for example in the form of a liquid, cream or paste, in particular for cosmetic or pharmaceutical use, or be in the form of a loose or compact powder.

It is known, in particular through document WO-2011/144840, a unit wherein a flexible pouch of product is arranged in a housing formed in a case, in particular in order to protect said pouch and/or to provide it with advantageous aesthetics. In particular, the case has a window wherein a dispensing zone can be accessed in order to be able to actuate the dispensing, in particular by manual pressing.

The dispensing can be carried out by the intermediary of a pump that has a pumping chamber provided with a dispensing opening, the actuating of said pump being carried out by flexible manual deformation of said pumping chamber. In particular, the dispensing zone can have a substantial extended surface allowing for the sliding of a finger along said zone in order to actuate the dispensing.

In order to benefit from a unit that can be refilled satisfactorily, it is desirable that the cassette be arranged reversibly in the housing of the case. In effect, once the cassette is empty, it is then possible to replace it with a full one without having to change the case.

In this embodiment, the pump and its dispensing zone can be integral with the cassette so as to, by benefiting from a new pump at each refill, prevent mixing the product contained in the pump with the product conditioned in the refill cassette. Furthermore, the prior conditioning of the product in the cassette makes it possible to prevent any risk of leakage and/or contamination of the product prior to the assembly of said cassette in the case.

However, the problem of the reversible assembly of the cassette in the housing of the case arises, in particular by precisely positioning the actuating zone in the window. In particular, this problem is all the more so critical when, in order to limit the refill frequency, the cassette has a capacity that is maximised in relation to the volume of the housing.

Furthermore, the problem of the reversible locking of the cassette mounted in the housing arises, in particular in order to firmly maintain in place said cassette during the actuating of its dispensing zone. In particular, this problem is all the more so critical in relation with an actuating zone of substantial surface and/or when the actuating is carried out by manual pressing on said zone.

The invention aims to improve prior art by proposing in particular a unit for dispensing wherein the cassette can be mounted and reversibly locked in the housing if the case in a particularly simple and reliable manner by arranging a dispensing zone of said cassette in a window of said case, and this more particularly in relation with an extended dispensing zone whereon manual presses for dispensing must be carried out.

To this effect, the invention proposes a unit for dispensing a product comprising a case and a cassette which has a zone for dispensing the product conditioned in a reservoir of said cassette, said cassette being intended to be arranged in a housing formed in a body of said case by arranging said dispensing zone in an access window which is formed in an upper wall of said body, said unit comprising a reversible locking mechanism of the cassette in the housing which has a frame mounted in horizontal translation in said housing by being maintained vertically, said frame and said cassette being provided with complementary means which are arranged to, in a first position of the frame, allow for the arrangement of the cassette in the housing with the dispensing zone in the window and, in a second position of said frame, lock the position of said cassette in said housing.

Other objects and advantages of the invention shall appear in the following description, given in reference to the annexed figures, wherein.

Figure 1:
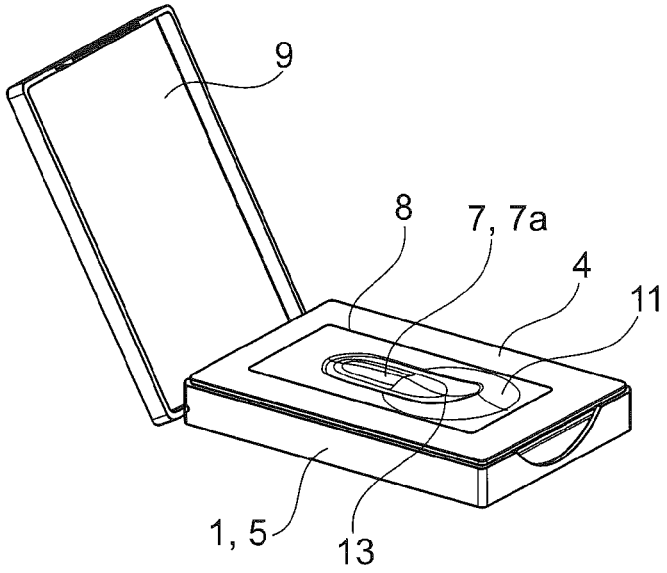
FIG. 1 is a top view in perspective of a unit for dispensing according to an embodiment of the invention, said unit being shown mounted and with the cover open.
Figure 2:
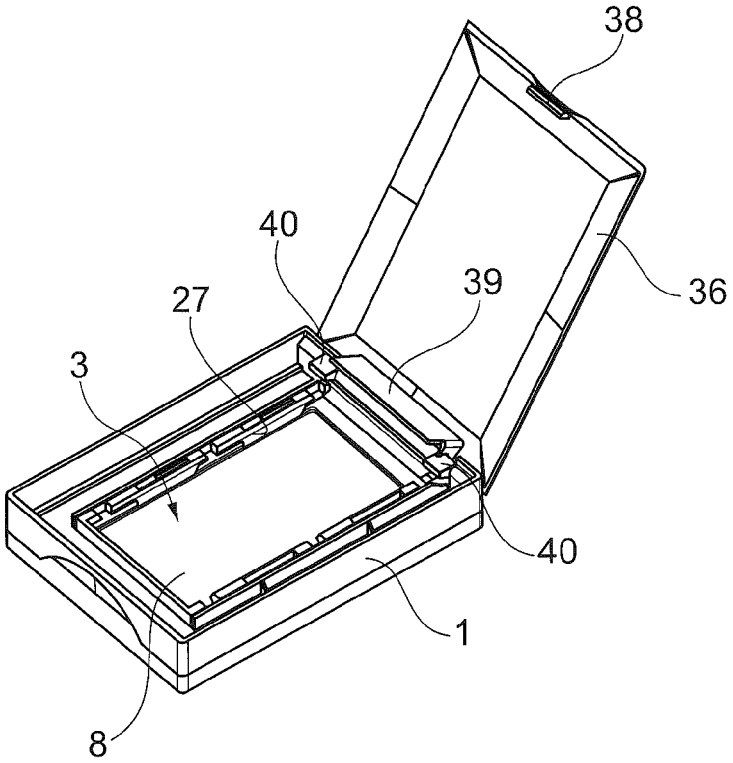
FIG. 2 is a bottom view in perspective of the unit for dispensing of FIG. 1, said unit being shown with the base in open position and without the cassette.
Figure 3A:
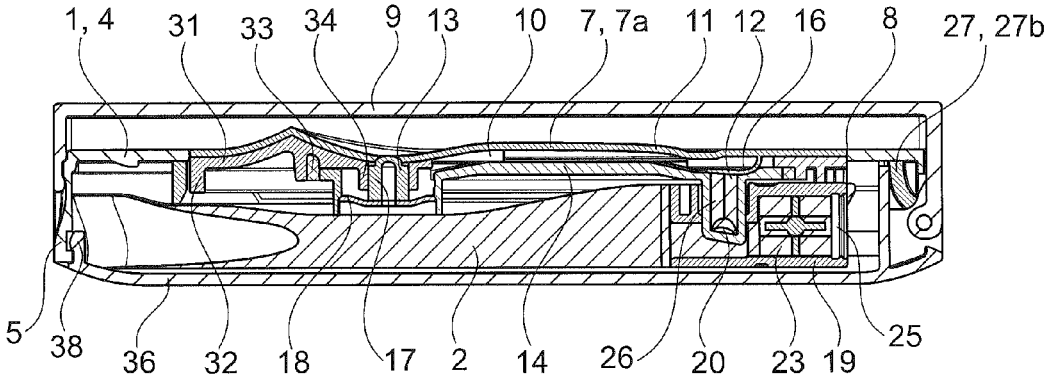
FIG. 3 show respectively a longitudinal cross-section (FIG. 3*a*) and a transverse cross-section (FIG. 3*b*) of the unit for dispensing according to FIG. 1.
Figure 3B:
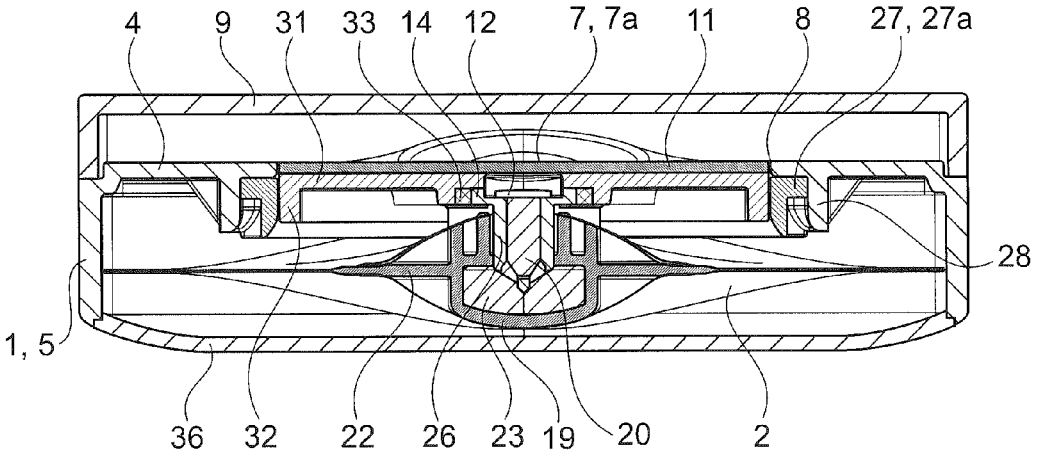
Figure 4:
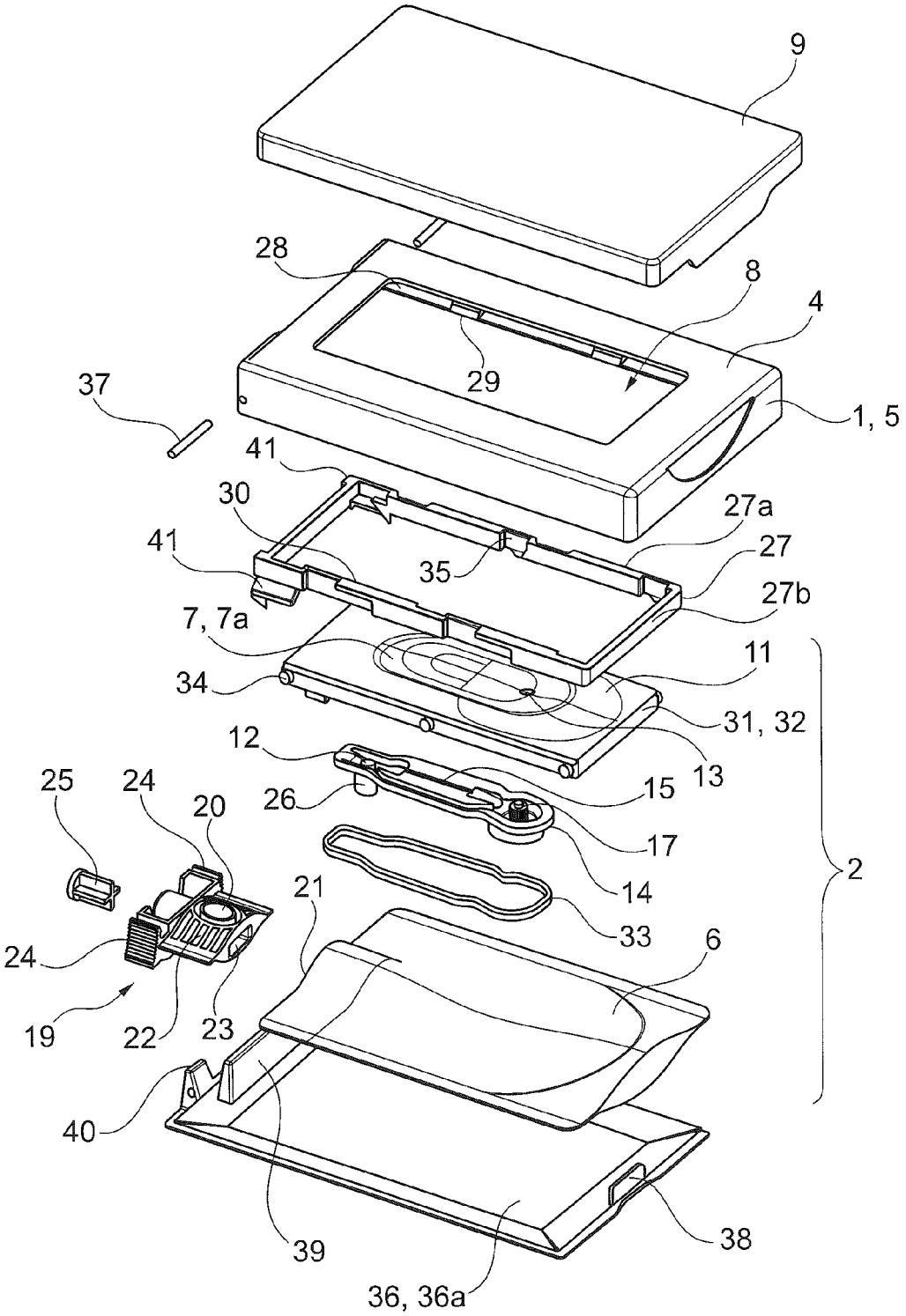
FIG. 4 shows an exploded view of the various components of the unit for dispensing according to FIG. 1.
Figure 5A:
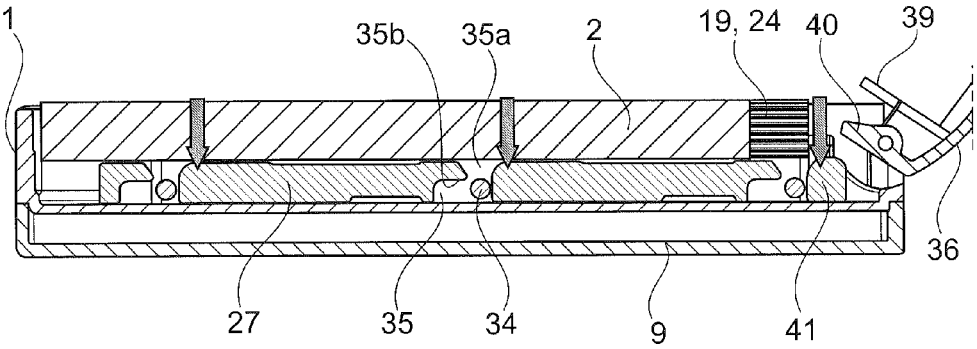
Figure 6A:
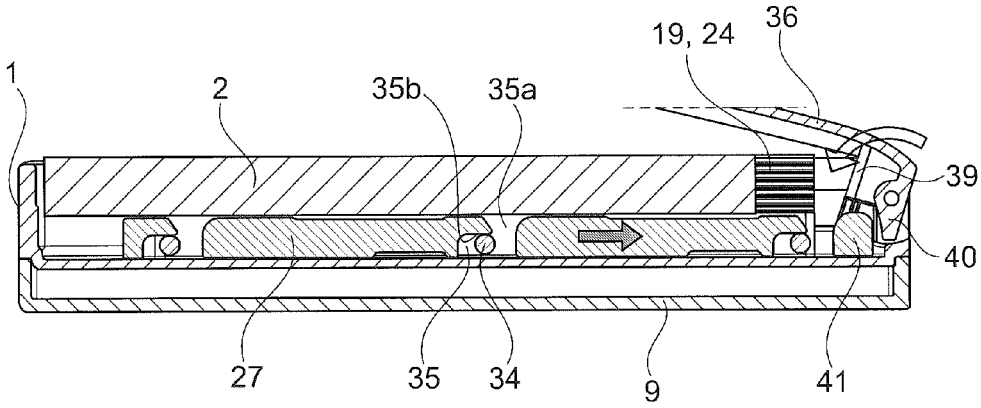
Figure 7A:
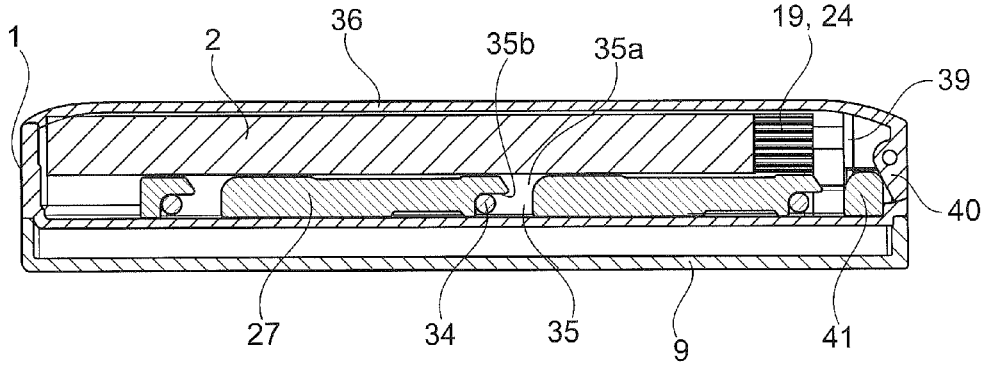
Figure 5B:
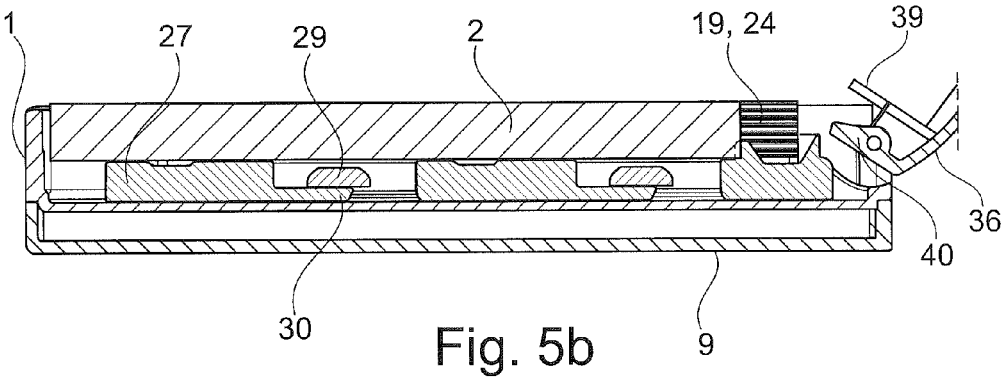
Figure 6B:
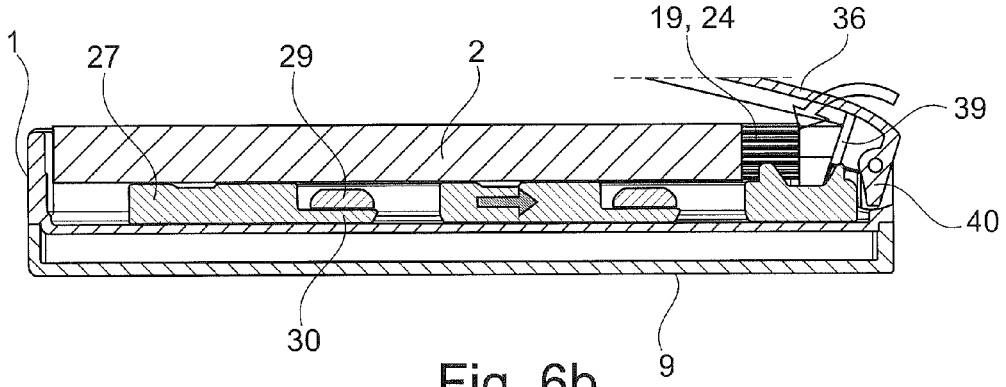
Figure 7B:
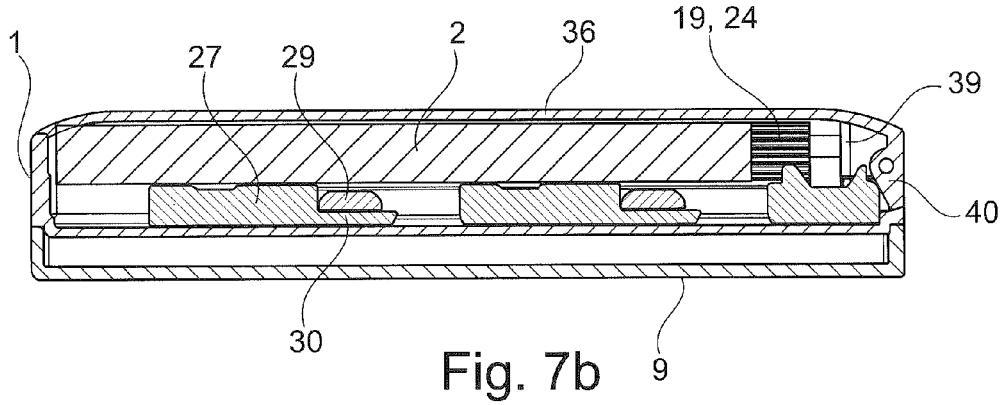
Figure 5C:
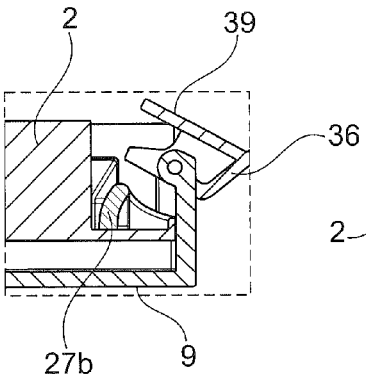
Figure 6C:
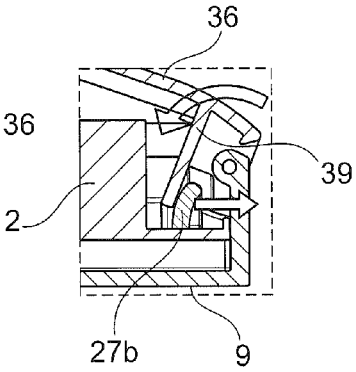
Figure 7C:
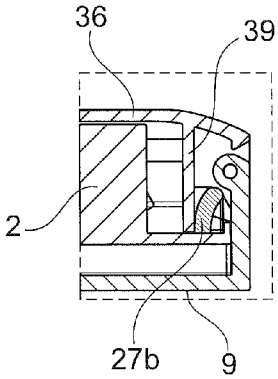
Figure 8:
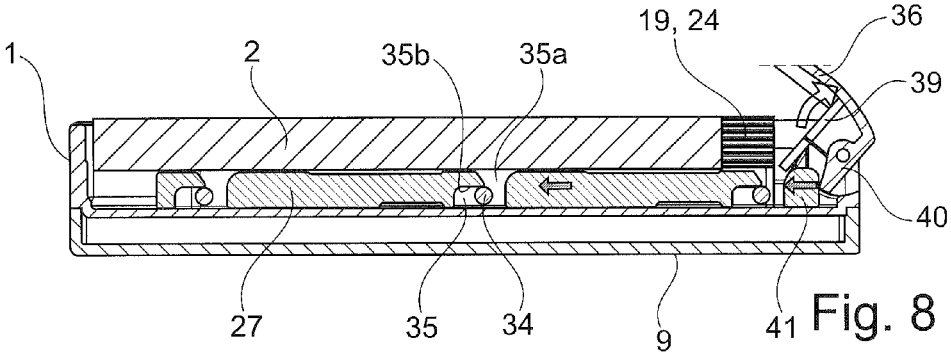
Figure 9:
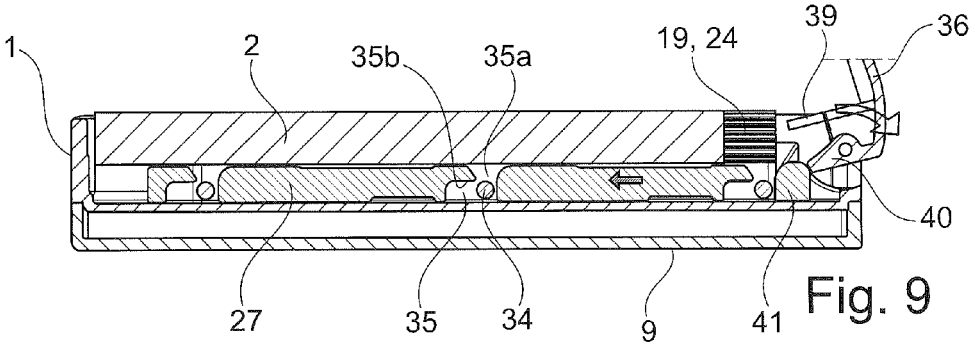
Figure 10:
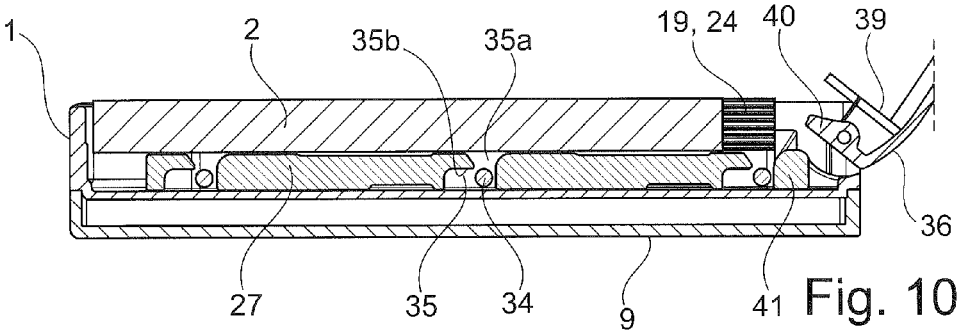

FIGS. 5 to 7 show three successive steps of the assembly and of the locking of the cassette in the housing of the case according to FIG. 1, respectively during the introduction of the cassette into the housing with the base in open position (FIG. 5), during the actuating of the displacement of the frame (FIG. 6) and in closed position of the base wherein the cassette is locked (FIG. 7), with the index of FIGS. 5 to 7 referring to a cross-section view according to a longitudinal plane passing respectively through the complementary means of the frame and of the cassette (FIGS. 5*a*, 6*a* and 7*a*), through the complementary means of assembly in translation of the frame (FIGS. 5*b*, 6*b* and 7*b*) and through the central axis of the case (FIGS. 5*c*, 6*c* and 7*c*);

FIGS. 8 to 10 show, as a cross-section according to a longitudinal plane passing through the complementary means of the frame and of the cassette, three successive steps for unlocking the cassette by opening of the base of the unit according to FIG. 1.

In the description, the terms of positioning in space are taken in reference to the position of use of the unit for dispensing shown in FIG. 1.

In relation with the figures, a unit intended to contain a fluid product for the purposes of dispensing it is described hereinbelow. In particular examples, the product can be in the form of a liquid, cream or paste, in particular for cosmetic or pharmaceutical use, or be in the form of a loose or compact powder.

The unit for dispensing comprises a case 1 and a cassette 2 having a reservoir wherein the product to be dispensed is conditioned. The unit is intended to be mounted by arranging the cassette 2 in a housing 3 formed in a body of the case 1. In particular, the assembly of the cassette 2 can be reversed in order to benefit from a refillable unit by replacing an empty cassette 2 with a full one without having to change the case 1.

The case 1 can be made of a rigid material, for example plastic or metal material, by having in particular a relatively flat shape with oval, round, square or rectangular geometry, as can be commonly found in the make-up market. According to an embodiment, the case 1 can be mounted in a covering in order to improve its aesthetics. In the embodiment shown, the case 1 has an upper rectangular horizontal wall 4 under which extends a vertical peripheral wall 5 that laterally delimits the housing 3 on its four sides.

The cassette 2 comprises a pouch 6 wherein the product to be dispensed is conditioned in a sealed manner and a device for dispensing a product conditioned by the intermediary of a dispensing zone 7. In particular, the pouch 6 has a flexible casing, in particular with a polyolefin base, delimiting the conditioning reservoir of the product, with the flexibility of said pouch making it possible to maximise the capacity of the cassette 2 by allowing for its optimal adaptation to the volume of the housing 3.

In order to allow the user access to the dispensing zone 7 of the cassette 2, the upper wall 4 of the case 1 has a window 8 wherein said dispensing zone is arranged. In particular, the dispensing zone 7 and the window 8 are of substantial size in relation to that of the upper wall 4, in particular an upper surface 30% and even exceeding 50% of said surface of said upper wall, in order to benefit from a dispensing zone 7 that is accessible and extended.

The dispensing zone 7 and the access window 8 can have identical geometry, in particular a similar size in order to be able to arrange said dispensing zone in a tight manner in said window. As such, the upper wall 4 and therefore the housing 3 are closed in the upper portion by the intermediary of the dispensing zone 7. In particular, the dispensing zone 7 is relatively flat and is flush against the upper wall 4 through the access window 8.

In the embodiment shown, the access window 8 has a rectangular geometry which is homothetic with that of the upper wall 4. The upper wall 4 has an edge that interiorly delimits the contour of the window 8, with said edge being connected exteriorly to the peripheral wall 5.

The case 1 comprises a cover 9 which is arranged to cover the dispensing zone 7 between two uses. In particular, the cover 9 can be articulated in rotation on a side of the peripheral wall 5 between an open access position to the dispensing zone 7 and a closed protective position of said zone between two uses. Furthermore, the cover 9 can be provided with a vanity mirror.

The device for dispensing shown comprises a pump having a pumping chamber 10 which is flexibly deformable by manual pressing on the dispensing zone 7. More precisely, the dispensing zone 7 has a flexibly deformable wall 11 that delimits the pumping chamber 10, said wall able to be made from material of the polyolefin type with shape memory or from an elastomeric material.

Advantageously in relation to the gestures for using the unit, the dispensing zone 7 comprises an upper pressing zone **7*a* having an extended geometry that is bordered on either side by a supply opening 12 of the pumping chamber 10 and by a dispensing opening 13 of the product in such a way as to allow a translation of the press exerted on the pumping chamber 10 from the vicinity of said supply opening in the direction of said dispensing opening. Furthermore, it can be provided that the dispensing opening 13 is formed in the extension of the pressing zone 7*a* in such a way, in the continuity of the actuating gesture of the pumping chamber 10**, as to collect the product on the finger.

In the embodiment shown, the flexibly deformable wall 11 is provided with the dispensing opening 13, the pumping chamber 10 being formed between said wall and a reinforcement 14 arranged on the pouch 6. In particular, the reinforcement 14 is arranged between the pouch 6 and the flexibly deformable wall 11, said reinforcement able to be carried out by moulding a rigid plastic material.

The reinforcement 14 has the opening 12 for the supply with product of the pumping chamber 10. Moreover, the dispensing 13 and supply 12 openings are provided with a valve respectively for the output and input which are arranged in order to allow, by deformation of the pumping chamber 10, for the dispensing of the product by the dispensing opening 13 and, via flexible return, the supply of the pumping chamber 10 by the supply opening 12.

In particular, the deformation of the pumping chamber 10 induces a pressurising of the product contained in said chamber, with said pressure causing the closing of the input valve and the opening of the output valve, with the aspiration induced by the flexible return of the pumping chamber 10 in the non-deformed state causing the opening of the input valve and the closing of the output valve.

In the embodiment shown, the pressing on the flexibly deformable wall 11 is carried out in particular vertically in order displace said wall in contact on the reinforcement 14. Furthermore, a press of the finger on the upstream end of the pressing zone **7*a*, i.e. the zone in the vicinity of the supply opening 12, causes the closing of the input valve, then a translation of the pressing exerted on the pumping chamber 10 in the direction of the dispensing opening 13 causes the opening of the output valve and the emptying of the pumping chamber 10**.

In particular, this embodiment is favoured when the reinforcement 14 has a guiding imprint 15, in particular made as a hollow by having a width substantially equal to that of a finger, said imprint being arranged across from the pressing zone **7*a*. Indeed, the seal of the pressing of the wall 11 on the imprint 15 is as such favoured in such a way as to facilitate the emptying of the pumping chamber 10 during the translation. Furthermore, in order to prevent a pressing of the finger on the valves, the supply 12 and dispensing 13 openings are arranged to the exterior of the imprint 15**.

Advantageously, the dispensing device allows for the pumping without air intake of the conditioned product, i.e., during dispensing, air does not enter into the pouch 6 as compensation for the dispensed product, and the flexibility of the casing allows for a reduction in the conditioning volume as the product is dispensed.

In the embodiment shown, the input valve is formed from a flexible lip 16 which is arranged to be thrust against the supply opening 12 during the deformation of the pumping chamber 10. In particular, the lip 16 is integrated under the flexibly deformable wall 11, said lip being inclined towards the pumping chamber 10 pressing on the supply opening 12. The lip 16 has an upper thrusting surface by pressurising the product in the pumping chamber 10 and can be raised from the supply opening 12 by aspiration of the product conditioned in the pouch 6.

Moreover, the output valve comprises a sealing punch 17 of the dispensing opening 13, said punch able to be reversibly displaced during the deformation of the pumping chamber 10. In particular, the reinforcement 14 has a surface wherein the punch 17 is mounted in sealed translation by the intermediary of a flexible collar 18 in such a way that the pressure exerted on said collar by the product coming from the pumping chamber 10 induces the reversible displacement of said punch outside of the dispensing opening 13.

The pouch 6 integrates a tip 19, for example carried out by moulding a plastic material, which is provided with a well 20 for putting the conditioned product into communication with the supply opening 12. In the embodiment shown, the pouch 6 has a mouth 21 and the tip has a curved base 22 whereon respectively an edge of the mouth is fixed, in particular by welding.

Furthermore, the well 20 extends vertically by opening in the upper surface of the base 22. The tip 19 also has a duct 23 that extends horizontally between an interior opening arranged in the pouch 6 and an exterior opening, with the well 20 opening into said duct in order to be in communication with the product conditioned by the intermediary of said duct.

Moreover, in the embodiment shown, the duct 23 is bordered by two lugs 24 forming means for manually grasping the cassette 2 in order to facilitate its assembly/withdrawal from the housing 3. In particular, the lugs 24 are arranged in order to allow them to be pinched between two fingers so as to be able to guide the cassette 2 in the housing 3 by arranging the dispensing zone 7 in the window 8.

Advantageously, before the assembly of the unit, the product is introduced into the pouch 6 by the intermediary of the duct 23, in particular by providing to empty the air from the pouch 6 beforehand in order to condition the product in the cassette 2 without air. Furthermore, the exterior opening is provided with a cap 25 which is driven into the duct 23 after the filling in order to seal the interior of the pouch 6.

In particular, the seal of the pouch 6 is carried out on the one hand, by the interference of the introducing of the cap 25 into the duct 23 and, on the other hand by the covering of the well 20 by the upper edge of the mouth 21. As such, the product can be conditioned easily in the pouch 6, in particular on conventional high-speed machines that condition the product then introduce the cap 25, with the pouch 6 then being hermetically sealed so that it can be stored and transported before providing it with the device for dispensing.

To do this, the reinforcement 14 comprises, moulded in a single part, a nipple 26 which is intended to be introduced into the well 20 in order to place the supply opening 12 in sealed communication with the product conditioned in the pouch 6. In the embodiment shown, the nipple 26 has a bore forming the supply opening 12 of the pumping chamber 10, with the periphery of said nipple being dimensioned to be fitted into the well 20.

The nipple 26 is arranged to allow for the perforation of the upper edge of the mouth 21 of the pouch 1 when it is introduced into the well 20. In particular, the nipple 26 can have a chisel tip that allows the casing to be perforated. As such, after assembly of the dispensing device on the pouch 6, the cassette 2 integrating the dispensing zone 7 of said device can be mounted in the housing 3 of the case 1, possibly as a refill.

The unit for dispensing comprises a reversible locking mechanism of the cassette 2 mounted in the housing 3 with the dispensing zone 7 in the window 8. In particular, the mechanism allows for the easy assembly/disassembly of the cassette 2 as well as a particularly reliable locking of the position of said cassette in the housing 3, in particular with regards to pressings that have to be carried out on the dispensing zone 7.

To do this, the locking mechanism has a frame 27 which is mounted in horizontal translation in the housing 3 by being maintained vertically, said frame and the cassette 2 being provided with complementary means which are arranged to, in a first position of the frame 27, allow for the arranging of the cassette 2 in the housing 3 with the dispensing zone 7 in the window 8 and, in a second position of said frame, lock the position of the cassette 2 in the housing 3.

In particular, the assembly of the cassette 2 can be carried out by displacing it vertically in the housing 3 by arranging the dispensing zone 7 in the access window 8, with the later displacement of the frame 27 in its second position making it possible to lock the position of the cassette 2 without displacing it in order to prevent affecting the arrangement of said actuating zone in said window.

In the embodiment shown, the body of the case 1 has a vertical wall 28 that extends under the upper wall 4, said vertical wall extending along each of the longitudinal sides of the window 8 by being arranged between said window and the peripheral wall 5. The frame 27 is mounted inside the vertical wall 28 by surrounding the window 8 so that the complementary means of said frame and of the cassette 2 are arranged as close as possible.

The frame 27 shown has a geometry identical to that of the window 8, i.e. rectangular, by having two longitudinal bars 27*a* connected at their ends by two transverse bars 27*b*, with each of the longitudinal bars 27*a* being guided in sliding along the vertical wall 28. Advantageously, the internal side of the longitudinal bars 27*a*, i.e. the side directed towards the cassette 2, has the complementary means, with the external side of said longitudinal bars having means for the guiding in translation of said frame along the vertical wall 28.

In the embodiment shown, the internal surface of the vertical wall 28 is provided with internal notches 29 which are arranged under horizontal ramps 30 formed on the external surface of the longitudinal bars 27*a* to guide the horizontal translation of the frame 27 in the housing 3 by providing for maintaining it vertically. In particular, during the displacement of the frame 27 into second position, the ramps 30 slide over the notches 29.

The cassette 2 comprises a support 31 whereon the flexibly deformable wall 11 is mounted, said support having a rectangular skirt 32 which is intended to be mounted in the frame 27. In particular, the reinforcement 14 is fixed under the support 31 by the intermediary of a joint 33, said support being arranged to surround said reinforcement and having a seat 34 wherein the punch 17 is guided in translation in relation to the dispensing opening 13.

In the embodiment shown, the skirt 32 is provided with complementary means. More precisely, the skirt 32 is provided with external pins 34 that extend over the longitudinal edges of said skirt. The internal surface of the longitudinal bars 27*a* comprises imprints that define housings 35 that each have a lower opening 35*a* and a hook 35*b*.

Each picot 34 is intended to be introduced vertically in a housing 35 by the intermediary of an opening 35*a* when the frame 27 is in first position and, when said frame is in second position, to be retained by a hook 35*b*. In particular, during the displacement of the frame 27 into second position, the hooks 35*b* slide under the pins 34. Furthermore, the openings 35*a* can have a geometry as a funnel in order to facilitate the insertion of the external pins 34 in the housings 35.

The case 1 comprises a base 36 which is articulated in rotation by the intermediary of axes 37 on a side of the peripheral wall 5 of the body of the case 1, in particular on the same side as that of the articulation of the cover 9, between an open access position to the housing 3 and a closed position wherein said base forms a lower wall of said housing. As such, in closed position which corresponds to the state of use of the unit, the housing 3 and therefore the cassette 2 are insulated from the exterior in order to reconcile protection and aesthetics.

To do this, the base 36 has a lower wall 36*a* with geometry similar to that of the upper wall 4 of the body of the case 1, said lower wall having two lateral edges, with one of said edges being articulated to the body and the other being provided with a locking prong 38 of said base in closed position.

Advantageously in relation to the refill gesture, the locking mechanism has a device for displacing the frame 27 which comprises complementary means provided on said frame and the base 36, said complementary means being arranged so that the closing of the base 36 induces the displacement of the frame 27 from its first to its second position. As such, the arrangement of the base 36 in open position allows for the assembly of the cassette 2 in the housing 3, the locking of the mounted cassette 2 being carried out by simple closure of the base 36.

In the embodiment shown, the device for displacing the frame 27 comprises at least one cam integral with the base 36 and, integral with the frame 27, a pressing surface of said came in order to transform the rotation of the base 36 into translation of said frame. More precisely, the articulated side of the base 36 comprises a central wall 39 that extends on the lower wall 36*a*, said wall forming a pressing cam on the transverse bar 27*b* which is arranged facing.

The device for displacing the frame 27 can further include complementary means which are arranged so that the opening of the base 36 induces the displacement of the frame 27 from its second to its first position. As such, the unlocking of the cassette 2 so that it can be replaced is carried out by simple opening of the base 36.

In the embodiment shown, the articulated side of the base 36 comprises two prongs 40 that surround the wall 39, said prongs being arranged in relation to said wall so as to not interfere with the displacement of the frame 27 in second position during the closing of the base 36. Furthermore, during the opening of the base 36, the prongs 40 press on bases 41 provided on each side of the transverse bar 27*b* in order to displace the frame 27 into first position.

In particular, the wall 39 is arranged to pull the transverse bar 27*b* towards the articulated side on an angular course of travel for closing the base 36 and the prongs 40 are arranged to push on the bases 41 over an angular course of travel for opening said base.

The invention claimed is:

1. A unit for dispensing a product comprising a case and a cassette that has a zone for dispensing the product conditioned in a reservoir of said cassette, said cassette intended to be arranged in a housing formed in a body of said case by arranging said dispensing zone in an access window which is formed in an upper wall of said body, said unit being characterised in that it comprises a reversible locking mechanism of the cassette in the housing that has a frame mounted in horizontal translation in said housing by being maintained vertically, said frame and said cassette being provided with complementary means which are arranged to, in a first position of the frame, allow for the arrangement of the cassette in the housing with the dispensing zone in the window and, in a second position of said frame, lock the position of said cassette in said housing.

2. The unit for dispensing according to claim 1, characterised in that the case comprises a base which is articulated on the body between an open access position to the housing and a closed position wherein said base forms a lower wall of said housing, with the locking mechanism having a device for displacing the frame which comprises complementary means provided on said frame and the base, said complementary means being arranged so that the closing of the base induces the displacement of the frame from its first to its second position.

3. The unit for dispensing according to claim 1, characterised in that the body of the case has a vertical wall which extends under the upper wall, with the frame being mounted inside said vertical wall by surrounding the window.

4. Unit for dispensing according to claim 1, characterised in that the body of the case is provided with internal notches which are arranged under the ramps formed on the frame in order to guide the horizontal translation of said frame in the housing by providing for maintaining it vertically.

5. The unit for dispensing according to claim 1, characterised in that the frame comprises imprints defining housings each having a lower opening and a hook, with the cassette being provided with external pins intended to be introduced into the housings by the intermediary of the openings when the frame is in first position and, when said frame is in second position, to be retained by the hooks.

6. The unit for dispensing according to claim 2, characterised in that the base is articulated in rotation on a side of the body of the case, with the device for displacing the frame comprising at least one cam integral with the base and, integral with the frame, a pressing surface of said cam for transforming the rotation of said base into translation of said frame.

7. The unit for dispensing according to claim 2, characterised in that the device for displacing the frame further comprises complementary means arranged so that the opening of the base induces the displacement of said frame from its second to its first position.

8. The unit for dispensing according to claim 1, characterised in that the cassette comprises means for manually grasping.

9. The unit for dispensing according to claim 1, characterised in that the cassette comprises a pouch wherein the product to be dispensed is conditioned and a device for dispensing the conditioned product by the intermediary of the dispensing zone.

10. The unit for dispensing according to claim 9, characterised in that the device for dispensing comprises a pump that has a pumping chamber which is flexibly deformable by manual pressing on the dispensing zone.

11. The unit for dispensing according to claim 10, characterised in that the dispensing zone has a flexibly deformable wall provided with a dispensing opening, the pumping chamber being formed between said wall and a reinforcement, said reinforcement having an opening for supplying the pumping chamber with product, with the dispensing and supplying openings being provided with a valve respectively for the output and the input which are arranged in order to allow, through deformation of the pumping chamber, the dispensing of the product by the dispensing opening and, via flexible return, the supply of the pumping chamber by the supply opening.

12. The unit for dispensing according to claim 11, characterised in that the flexibly deformable wall is mounted on a support having a skirt intended to be mounted in the frame, said skirt being provided with complementary means.

13. The unit for dispensing according to claim 11, characterised in that the pouch integrates a tip-which is provided with a well for placing the product conditioned into communication with the supply opening.

14. The unit for dispensing according to claim 1, characterised in that the case comprises a cover which is arranged to cover the dispensing zone between two uses.

15. The unit for dispensing according to claim 1, characterised in that the product is conditioned in the cassette without air.

* * * * *